United States Patent [19]

Jimenez et al.

[11] Patent Number: 5,050,277

[45] Date of Patent: Sep. 24, 1991

[54] SEAT BELT BUCKLE ACTUATOR ACCESSORY

[76] Inventors: Ivan Jimenez; Irving Rubin, both of 5555 Treadwell, Wayne, Mich. 48184

[21] Appl. No.: 37,806

[22] Filed: Apr. 13, 1987

[51] Int. Cl.[5] ..... A44B 11/26

[52] U.S. Cl. ..... 24/633

[58] Field of Search ..... 116/172; 200/340, 333; 400/495, 496; 24/633-642, 573, 574

[56] References Cited

U.S. PATENT DOCUMENTS

| | | | |
|---|---|---|---|
| 559,416 | 5/1896 | Soper | 200/340 X |
| 2,032,168 | 2/1936 | Degen | 400/496 X |
| 3,296,404 | 1/1967 | Stevens | 200/333 X |
| 3,566,455 | 3/1971 | Kuszynski | 24/633 |
| 3,588,969 | 6/1971 | Fisher | 24/637 |
| 4,363,942 | 12/1982 | Deeg et al. | 400/495 X |
| 4,391,023 | 7/1983 | Tanaka et al. | 24/633 |
| 4,480,163 | 10/1984 | Morris et al. | 200/340 X |
| 4,624,033 | 11/1986 | Orton | 24/633 |
| 4,638,533 | 1/1987 | Gloomis et al. | 24/573 X |
| 4,675,954 | 6/1987 | Gullickson | 24/633 |

FOREIGN PATENT DOCUMENTS

| | | | |
|---|---|---|---|
| 3136020 | 11/1982 | Fed. Rep. of Germany | 200/340 |
| WO8401275 | 4/1984 | PCT Int'l Appl. | 24/633 |

*Primary Examiner*—James R. Brittain

*Attorney, Agent, or Firm*—Alex Rhodes

[57] ABSTRACT

An accessory actuator for an occupant restraint system buckle which gives the owner of an automotive vehicle a choice in rendering the restraint belts in the vehicle more convenient for unlatching. The accessory comprises a molded plastic accessory button which can be installed without the use of separate tools and without having to modify the existing buckle. The button has a head disposed exterior of the pre-existing buckle casing and a neck which extends from the head to join with the pre-existing actuating button of the buckle. The accessory button joins to the pre-existing button by pressing the adhesive containing end of the neck against the pre-existing actuating button.

3 Claims, 1 Drawing Sheet

SEAT BELT BUCKLE ACTUATOR ACCESSORY

BACKGROUND AND SUMMARY OF THE INVENTION

This invention relates generally to occupant restraint systems for automotive vehicles. More specificaly it relates to an accessory for use with a pre-existing occupant restraint system. The accessory comprises an accessory actuator button which joins with the pre-existing actuator button of the restraint system's buckle to enable a person to unlatch the buckle in a more convenient manner than through use of the pre-existing actuator button alone.

A typical automotive vehicle occupant restraint system has a buckle attached to the free end of a piece of belting whose opposite end is anchored on the vehicle body; the anchoring may be either a direct fastening or via a device such as a retractor. A tongue is attached to a free end of a complementary piece of belting whose opposite end is anchored on the body. When the restraint system is in use to restrain a seated occupant, the two pieces of belting are connected by inserting the tongue of the one piece into the buckle of the other piece and adjusting the restraint around the occupant.

The buckle comprises a casing which contains a spring-loaded lacthing mechanism for releaseably latching the buckle to the tongue. A typical buckle casing comprises an aperture which exposes an actuating button for depression by a person's thumb or fingertip to cause the latching mechanism to release the buckle from latching condition. In today's typical buckle the area of the actuating button which is exposed by the aperture approximates that of the thumb or fingertip. The button surface against which the thumb or fingertip presses is generally flush with the surface of the casing containing the aperture.

For any of a number of various reasons, a person may be impaired from unlatching a buckle of this type. For instance, in winter weather the use of mittens, especially bulky ones, makes it difficult to operate the actuating button. Some people may have physical conditions which impair their ability to unlatch a buckle. Hence, in situations such as these, a more convenient way to release the buckle from its latching condition is desireable, but the automobile manufacturers give the customer no choice in this matter.

Many women dislike this type of buckle because it is difficult to operate with long fingernails. Attempts to unlatch the buckle can cause ladies' fingernails to crack and/or break, and this tends to discourage them from using the restraint.

The present invention relates to an accessory actuator for an occupant restraint system buckle which gives the owner of an automotive vehicle a choice in rendering the restraint belts in the vehicle more convenient for unlatching. Briefly, the invention comprises an accessory button which can be installed by the owner of the vehicle without the use of separate tools and without having to modify the exiting buckle.

The preferred embodiment of the invention contemplates a molded plastic accessory button having a head disposed exterior of the pre-existing buckle casing and a neck which extends from the head to join with the pre-existing actuating button of the buckle. The distal end of the accessory button neck comprises an adhesive attachment which is covered by a strippable release paper prior to use. When the accessory button is to be installed, the release paper is stripped away to expose the adhesive. The accessory button is joined to the pre-existing button by pressing the adhesive-containing end of the neck against the pre-existing actuating button. The adhesive is of a type, such as an epoxy, which bonds well to the actuating button, be it metal or a non-metal such as plastic. The neck and head of the accessory button are dimensioned such that the head is disposed a certain distance from the casing so as to be capable of travel toward the casing in an amount at least equal to the amount of travel required for depressing the pre-existing actuating button to unlatching condition.

The foregoing features, advantages and benefits of the invention, along withe additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
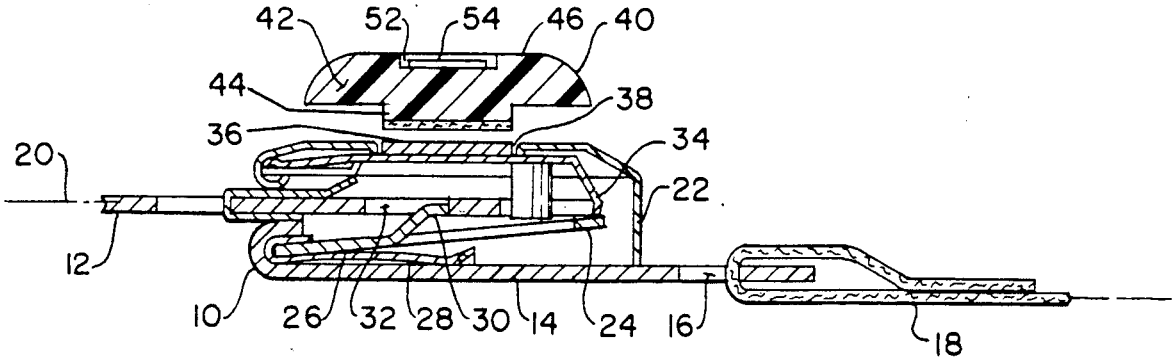
FIG. 1 is a longitudinal elevational cross section through a typical seat belt buckle and tongue in the latching condition and further illustrating in exploded relation the application of the accessory actuating button of the present invention.

FIG. 1 shows a representative buckle 10 in latching engagement with a tongue 12. Buckle 10 comprises a base 14 having a slot 16 through which one end of a piece of belting 18 is looped and secured back unto itself. The opposite end of belting 18 leads to a suitable anchoring location on a vehicle. Tongue 12, likewise, has an attachment to one end of a piece of belting 20 whose opposite end is anchored at a suitable location on the vehicle.

Buckle 10 further comprises a casing 2 fitted onto base 14. The casing and base cooperatively form an enclosure within which a releasable latching mechanism 24 of the buckle is housed. Mechanism 24 comprises a latch member 26 and a spring member 28. Latch member 26 is formed with a centrally located catch 30 which in the position shown in FIG. 1 is biased by spring member 28 into latching engagement with tongue 12 by being disposed within a central hole 32 formed in tongue 12.

The latching mechanism is operated by an actuating button 34 which overlies the latching mechanism within the enclosure of the casing. The actuating button has a central surface area 36 in registry with an aperture 38 formed in the top of casing 22. In the position shown in FIG. 1 the spring bias imparted to latch member 26 serves to dispose actuating button 34 in the illustrated position wherein the surface area 36 is substantially flush with the exterior surface of the casing surrounding aperture 38.

Operation of latching mechanism 24 to the unlatching condition (represented by FIG. 2) is performed by depressing the central area 36 of actuating button 34 downwardly into casing 22. The action displaces latch member 26 downwardly against the opposition of spring 28 to cause catch 30 to clear hole 32. This allows tongue 12 to be withdrawn from the casing by sliding movement to the left as viewed in FIG. 1. Upon release of button 34, spring 28 returns latch member 26 to the position shown in FIG. 1..

Further details of representative constructions of pre-existing seat belt buckles appear in a number of issued U.S. patents, and reference may be had to U.S. Pat. No. 3,781,967 issued Jan. 1, 1974, by way of example.

According to principles of the invention, an accessory actuator button 40 is cooperatively associated with buckle 10. Button 40 comprises a head 42 and a neck 44. Neck 44 has a transverse cross sectional shape which enables it to pass through aperture 38, preferably with a fairly close fit within the aperture but free of interference with the aperture's edge. In the illustrated embodiment the aperture and the neck have generally square shapes.

The distal end of neck 44 contains an adhesive joining means 46 which provides for the joining of the accessory button to the pre-existing actuating button 34 of the seat belt buckle. The distal end surafce is essentially flat and comprises in the preferred embodiment a layer of conforming material 48, such as foam or pad, which has essentially the same area as the distal end of neck 44. One surface of the material layer 48 is adhered against the distal end of neck 44 by adhesive; the opposite surface of layer 48, prior to use, is covered by a strippable release paper 50. Upon stripping of the release paper 50 away from layer 48 as portrayed in FIG. 4, the adhesive on the now exposed surface is available to provide for joining of the accessory to the pre-existing actuating button when the accessory button is oriented as in FIG. 1 and pressed downwardly on to the central surface area 36 of the actuating button 34. Through use of conventional adhesives, such as epoxies, contact cement, and the like, a very secure bonding of the accessory button to the pre-existing actuating button is assured.

Figure 2:
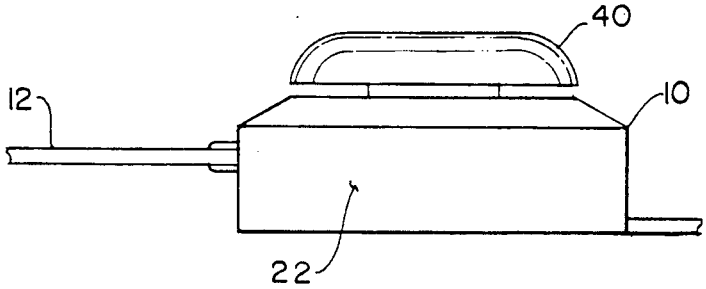
FIG. 2 is an elevational view similar to FIG. 1 illustrating the accessory actuating button of the invention installed on the seat belt buckle and in the unlatching condition.

Neck 44 has an axial dimension, or length, such that when the actuating button is fully depressed into the casing thereby fully depressing the latching mechanism within the interior of the casing, head 42 does not contact the outside surface of the casing (FIG. 2).

Head 42 has an area which closely conforms to the surface area of the casing which contains aperture 38, thereby overlapping the margin of the aperture to have congruence with the edge of the casing surface which contains the aperture. The illustrated example shows a generally rectangular shape with rounded corners and with a convex rounded upper marginal edge. In the example, the axial dimension of the actuating button's head is approximately equal to the axial dimension of the neck. In this way, the head of the actuating button does not protrude in an excessive amount from the casing. The head and neck are coaxial.

Figure 3:
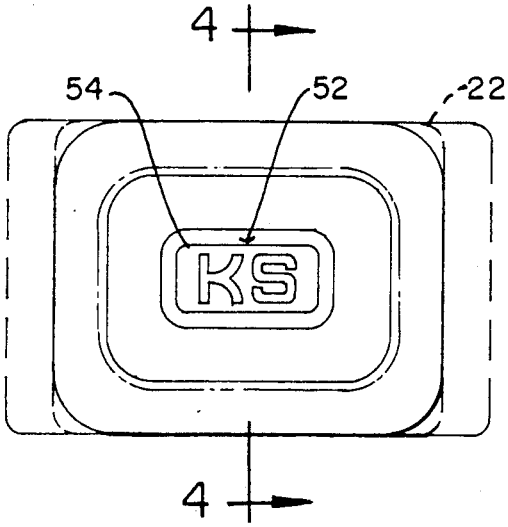
FIG. 3 is a top plan view, on an enlarged scale from FIGS. 1 and 2, of the actuating button of the present invention with the outline of the pre-existing buckle being shown by broken lines.
Figure 4:
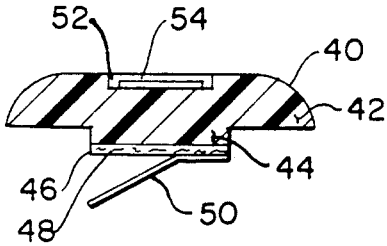
FIG. 4 is a transverse cross sectional view taken in the direction of arrows 4-4 in FIG. 3 illustrating the actuating button of the present invention by itself.

The central region of the upper surface of head 42 contains a rectangular depression 52. A decorative label 54 is adhered in this depression as illustrated in FIGS. 3 and 4. In the example, the label contains initials or monograms presenting a distinctive appearance.

The preferred embodiment of accessory button comprises a one-piece molded plastic to which the layer 48 and label 54 are adhered. The broader aspects of the invention however contemplate that other means of joining of the accessory button to the pre-existing actuating button could be used. It is also contemplated that alternate materials, shapes, and processes for the actuating button likewise can be used.

The accessory button is an optional convenience which give the owner of an automotive vehicle a choice of more convenient actuation of the seat belt buckle. Use of the accessory button for actuation of the seat belt buckle does not depend upon one's thumb or fingertip depressing the pre-existing actuating button inside the casing. The accessory button presents a much larger area which lies on the exterior of the casing, and while it can be operated by a thumb or fingertip it can also be operated by tapping with the side or with palm of the hand, thereby making the possibility of fingernail damage much less likely than would be the case without the accessory button. The product is adapted for installation by the customer, and in the illustrated construction does not require the use of separate tools nor does it require disassembly of the seat belt buckle mechanism. It can be sold over the counter in accessory or convenience stores.

While a preferred embodiment of the invention has been disclosed, it will be appreciated that principles are applicable to other embodiments.

What is claimed is:

1. In combination with a pre-existing restraint system for restraining a seat occupant by means of belting wherein portions of the belting releaseably connect via a buckle and tongue to gird the occupant, and the buckle is of the type comprising a casing which contains a spring-loaded latching mechanism for releaseably latching the buckle and the tongue when the two are mutually engaged, said casing comprising an aperture which exposes an actuating button for depression by a person's thumb or fingertip to cause the latching mechanism to release the buckle and tongue from latching condition, the improvement which comprises an accessory button for more conveniently operating the actuating button, said accessory button comprising a head portion disposed exterior of the buckle casing and a neck portion which extends from the head portion to join with the actuating button, said neck portion of said accessory button being joined to the actuating button of the pre-existing buckle by means of an adhesive which bonds the distal end of the neck portion to the actuating button and having an organization and arrangement of its head and neck portions such that depression of the accessory button head portion toward the casing is effective via the accessory button's neck portion to depress the actuating button sufficiently to cause the latching mechanism to release the buckle and the tongue from latching condition.

2. In combination with a pre-existing restraint system for restraining a seat occupant by means of belting wherein portions of the belting releaseably connect via a buckle and tongue to gird the occupant, and the buckle is of the type comprising a casing which contains a spring-loaded latching mechanism for releaseably latching the buckle and the tongue when the two are mutually engaged, said casing comprising an aperture which exposes an actuating button for depression by a person's thumb or fingertip to cause the latching mechanism to release the buckle and tongue from latching condition, the improvement which comprises an accessory button for more conveniently operating the actuating button, said accessory button comprising a head portion disposed exterior of the buckle casing and a neck portion which extends from the head portion to join with the actuating button, said accessory button being a one piece molded plastic element which includes in assembly, a layer of compliant adhesive-containing material on the neck portion at the location where the neck portion joins with the actuating button of the pre-existing buckle, and the adhesive serves to bond the layer of material to both the neck portion of the accessory button and to the pre-existing buckle's actuating button, said accessory button having an organization and arrangement for its head and neck portions such that depression of the accessory button head portion toward the casing is effective via the accessory button's neck portion to depress the actuating button sufficiently to cause the latching mechanism to release the buckle and the tongue from latching condition.

3. The improvement set forth in claim 2 in which the area of expanse of said layer of material is substantially equal to the exposed area of the actuating button of the pre-existing buckle.

* * * * *

UNITED STATES PATENT AND TRADEMARK OFFICE

CERTIFICATE OF CORRECTION

PATENT NO. : 5,050,277

DATED : Sept. 24, 1991

INVENTOR(S) : Ivan Jimenez; Irving Rubin

It is certified that error appears in the above-identified patent and that said Letters Patent is hereby corrected as shown below:

Column 1, line 27, change "lacthing" to --latching--

Column 1, line 60, change "exiting" to --existing--

Column 2, line 15, change "withe" to --with--

Column 2, line 53, change "casing 2" to --casing 22--

Column 3, line 32, change "surafce" to --surface--

Column 4, line 53, change "of" to --for--

Signed and Sealed this

Twelfth Day of January, 1993

*Attest:*

DOUGLAS B. COMER

*Attesting Officer*

*Acting Commissioner of Patents and Trademarks*